United States Patent [19]

Palomera

[11] Patent Number: 4,465,115

[45] Date of Patent: Aug. 14, 1984

[54] HAMMERHEAD

[76] Inventor: Louis M. Palomera, 4091 Manzanita, Irvine, Calif. 92714

[21] Appl. No.: 478,300

[22] Filed: Mar. 24, 1983

[51] Int. Cl.[3] ..... B25C 1/00

[52] U.S. Cl. ..... 145/30 A

[58] Field of Search ..... 145/30 A, 30 R

[56] References Cited

U.S. PATENT DOCUMENTS

| | | | |
|---|---|---|---|
| 83,897 | 11/1868 | Zimmerman . | |
| 418,539 | 12/1889 | Stark . | |
| 509,399 | 11/1893 | Richardson . | |
| 569,161 | 10/1896 | Balsley . | |
| 745,973 | 12/1903 | Starrett . | |
| 759,558 | 5/1904 | Scholtes . | |
| 937,987 | 10/1909 | Carlson . | |
| 1,477,833 | 12/1923 | Leak . | |
| 1,742,032 | 12/1929 | Gregersen . | |
| 2,597,876 | 5/1952 | Kurkjian | 145/30 A |
| 3,543,821 | 12/1970 | Johnson . | |
| 3,987,828 | 10/1976 | Matheis | 145/30 A |
| 4,273,172 | 6/1981 | Hoosier | 145/30 A |

FOREIGN PATENT DOCUMENTS

| | | | |
|---|---|---|---|
| 141678 | 10/1949 | Australia | 145/30 A |
| 1335243 | 7/1963 | France | 145/30 A |

*Primary Examiner*—Frederick R. Schmidt
*Assistant Examiner*—J. T. Zatarga
*Attorney, Agent, or Firm*—Hubbard & Stetina

[57] ABSTRACT

An improved hammerhead is disclosed characterized by nail retaining means for facilitating initial driving of the nail without the requirement of holding the nail in the hand of a user. The nail retaining means incorporates an elongate recess sized to receive and self-align the shank portion of the nail upon the hammerhead, an angular-shaped pocket sized to receive the head portion of the nail and a magnet insert positioned proximal the angular-shaped pocket adapted to maintain the nail in the elongate recess during initial driving. The magnet insert is readily removable from the hammerhead to permit rapid replacement after its magnetic flux force has deteriorated through prolonged use.

4 Claims, 3 Drawing Figures

HAMMERHEAD

BACKGROUND OF THE PRESENT INVENTION

The present invention relates to hammerheads and, more particularly, to an improved hammerhead having means for facilitating initial driving of the nail or the like without the requirement of holding the nail in the hand of a user.

As is well known in the construction trade, it is customary practice to drive nails into a nailing surface by initially positioning the nail where desired by grasping the nail in one hand of a user and subsequently impacting a hammer held by the other hand of the user unto the head of the nail. This customary practice, however, has oftentimes resulted in harm to the fingers or hands of a user due to the hammer slipping off the nailhead during impact or has proven difficult in certain nailing applications where, for instance, the user was required to hold the nailing surface in position during nailing or where the desired location of the nail was beyond the normal arm reach of the user.

Although these safety and application deficiencies have been recognized to a limited extent in the prior art, the solutions to date have comprised either mechanical, magnetic or combined mechanical, magnetic hammer structures adapted to retain the nail on the head of the hammer. Examples of such prior art structures are disclosed in U.S. Pat. No. 2,597,876—Kurkjian, U.S. Pat. No. 3,543,821—Johnson, French Pat. No. 1,335,243—Favero, U.S. Pat. No. 1,477,833—Leak, U.S. Pat. NO. 937,987—Carlson, U.S. Pat. No. 745,973—Starrett, U.S. Pat. No. 83,897—Zimmerman, U.S. Pat. No. 569,161—Balsley, U.S. Pat. NO. 759,556—Scholtes, U.S. Pat. No. 418,539—Stark, U.S. Pat. No. 1,742,032—Gregersen, and U.S. Pat. No. 509,399—Richardson. The prior art mechanical hammerhead structures have typically been inapplicable to be retrofitted into conventional hammer designs due to their rather intricate cast or machined structure, have been cost prohibited for widespread use or have proven incapable of adequately holding the nail upon the hammerhead during initial impact of the hammerhead. Alternatively, most if not all of the magnetic hammerhead structures have proven deficient after prolonged use due to the natural gradual weakening of the magnetic flux force which has typically resulted in the hammerhead being incapable of accomplishing its intended function.

Thus, there exist substantial need in the art for an improved hammerhead having means for retaining the nail upon the hammerhead during initial driving of the nail which can be incorporated into conventional hammer designs at relatively low cost, and be properly utilized for prolonged period of use without decreasing in operational efficiency.

SUMMARY OF THE PRESENT INVENTION

The present invention specifically addresses and alleviates the above-referenced need associated in the art by providing an improved hammerhead characterized by nail retaining means for facilitating initial driving of the nail without the requirement of holding the nail in the hand of a user. The particular nail retaining means incorporated into the hammerhead of the present invention includes an elongate recess adapted to receive and self-align the shank portion of the nail upon the hammerhead. The elongate recess terminates in an angular-shaped pocket which is adapted to receive the head portion of the nail to be driven. A magnetic insert is positioned proximal the angular-shaped pocket and contacts the nail to maintain the same within the elongate recess and angular-shaped pocket. The magnet insert is readily removable from the hammerhead to permit rapid replacement after its magnetic flux force has deteriorated through prolonged use.

In the preferred embodiment, the magnet insert is formed in a conventional magnet configuration which can be purchased at most hardware and home improvement stores and is recess mounted into the hammerhead by way of a complimentary shaped cavity or bore formed in the hammerhead. In a first embodiment of the invention, the magnetic force of the magnet insert itself is utilized to maintain the insert within the hammerhead during use of the hammerhead. However, in a second embodiment of the invention, the magnetic insert includes an axial aperture adapted to receive a flathead machine screw to retain the insert in its complimentary shaped cavity on the hammerhead. As such, the present invention is capable of prolonged use merely by rapidly replacing the magnetic insert with a new magnetic insert readily available from standard retail supplies.

In addition, due to the magnetic insert being positioned in close proximity to the head portion of the nail, the applicant has found that the nail is sufficiently retained on the hammerhead during impact of the hammer upon a surface such that even the most difficult nailing applications can be accommodated. In addition, the hammerhead structure of the present invention can be easily retrofitted into existing hammerhead designs at relatively low cost and is capable of being produced by use of high production manufacturing techniques.

DESCRIPTION OF THE DRAWINGS

These as well as other features of the present invention will become more apparent upon reference to the drawings, wherein.

DETAILED DESCRIPTION OF THE PREFERRED EMBODIMENT

Figure 1:
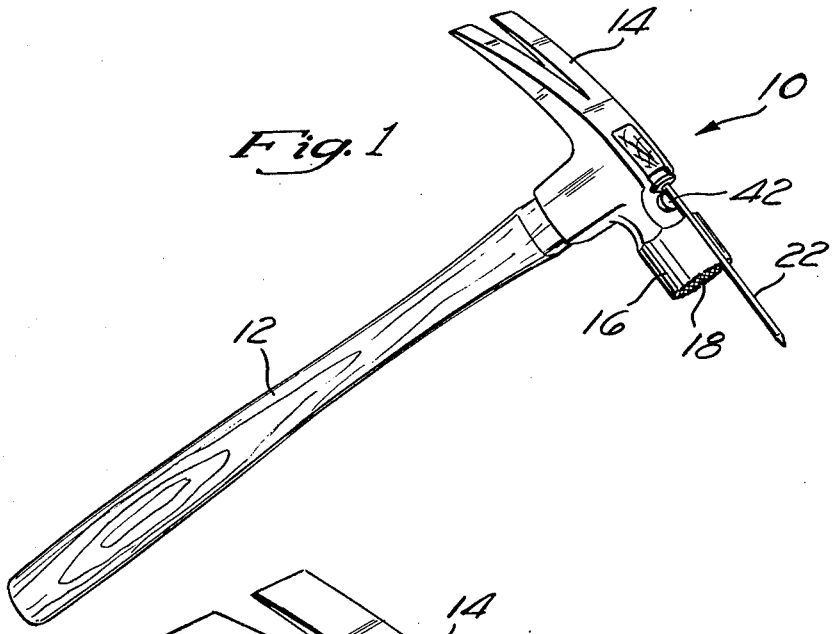
FIG. 1 is a perspective view of the improved hammerhead of the present invention illustrating the manner in which a nail may be maintained and registered thereon.
Figure 2:
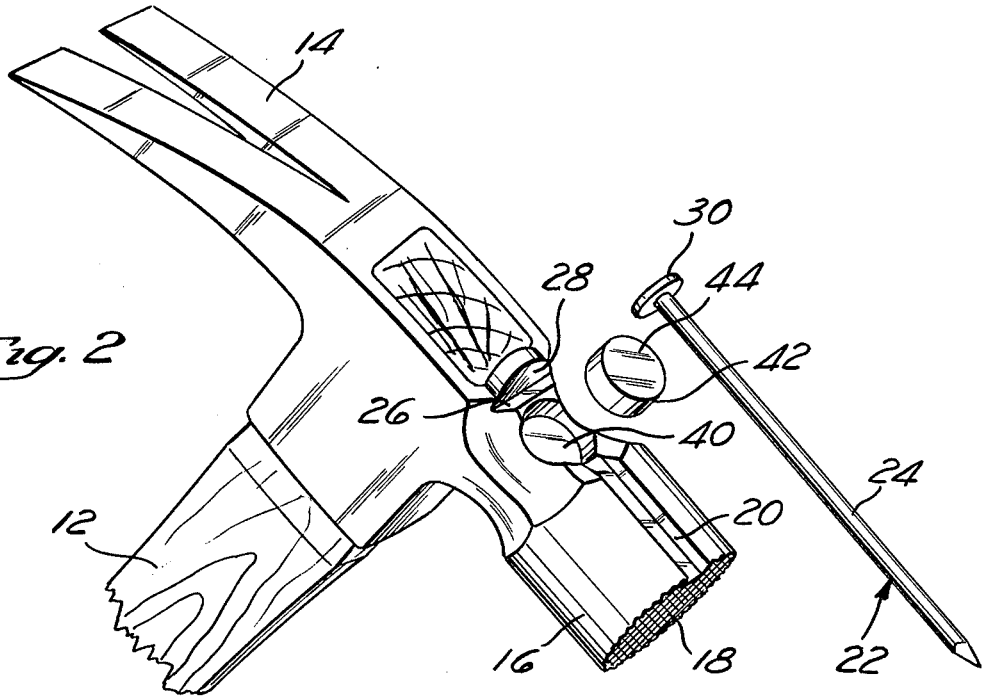
FIG. 2 is an enlarged exploded view of a first embodiment of the hammerhead of the present invention illustrating its detailed construction.

Referring to FIGS. 1 and 2, there is shown the improved hammerhead 10 of the present invention which may be attached in a conventional manner to a handle 12. The hammerhead 10 may be formed by any conventional forging or casting production technique and preferably includes a claw portion 14 disposed at one of its ends and adapted to withdraw nails from a nailed surface (not shown) in a well-known manner. The opposite end of the hammerhead 10 is provided with a shank portion 16 terminating in a annular face 18 adapted to provide the main nail impact surface for the hammerhead 10.

Referring more particularly to FIG. 2, it may seen that the shank portion 16 includes a longitudinally extending recess 20 which extends from the face 18 toward the central portion of the hammerhead. The width and depth of the recess 20 is preferably sized to accommodate differing diameters of nails or the like 22 such that the stem or shank portion 24 of the nail 22 may be received within the recess 20. An angular-shaped pocket 26 is additionally provided in the shank portion 16 of the hammerhead 10 and includes a rear abuttment wall or shoulder 28 extending in a plane generally perpendicular to the plane of the recess 20. The pocket 26 is sized to receive the head portion 30 of the nail 22 therein.

A cavity or bore 40 is positioned between the recess 20 and pocket 26 and is formed in a complimentary shape and size to a magnet insert 42. In the preferred embodiment, the magnet insert 42 comprises a natural magnet which is a configuration routinely marketed in hardware and home improvement centers. The depth of the pocket 40 is sized to be equal to or slightly less than the depth of the insert 42 such that when the insert 42 is positioned within the cavity 40, the top planer surface 44 of the insert 42 is generally co-planer with or slightly below the recess 20. Once positioned within the cavity 40, the insert 42 due to its magnetic flux force and complimentary shape to the cavity 40, is maintained in position upon the hammerhead 10.

With the structure defined, the operation of the hammerhead of the present invention may be described. In those instances where it is desired to utilize the hammerhead 10 in a conventional nailing application, the user merely grips the handle 12 and impacts the face 18 of the hammerhead 10 against the nail to be driven. However, in those instances where the user desires to impact a nail without requiring the nail to be held in the opposite hand of the user, for instance to meet certain nailing applications or to increase the arm reach of the user, the user need only manually position the nail 22 upon the hammerhead such that the shank portion 24 of the nail resides within the recess 20 and the head portion 30 resides within the pocket 26. Positioned in such a manner, it will be recognized that the shank poriton 24 of the nail 22 is self-aligned within the recess 20 to be in a generally parallel axis to the central axis of the flange portion 26 of the hammer while the head portion 30 is disposed in a generally co-planer position with the abuttment wall 28.

Once positioned in such a manner, it will be recognized that the magnet insert 42 serves to apply a constant magnetic attractive force to the nail 22 to maintain the nail 22 upon the hammerhead 10. As such, the user may subsequently grasp the handle 12 of the hammerhead 10 and swing the head unto a nailing surface (not shown) with the nail 22 remaining in registered position upon the hammerhead 10. Upon impact of the nail 22 with contacting the surface, it will be recognized that the abuttment wall 28 serves as a secondary impactment surface to the nail 22 to initially insert the nail 22 into the nailing surface. Once the nail 22 has been inserted into the nailing surface, a user may pivot the hammerhead 10 to overcome the attractive force of the magnet insert 42 to the nail 22 and separate the hammerhead 10 from the nail wall leaving the nail 22 in the nailing surface. Further impaction of the hammerhead 10 upon the nail 22 may then be accomplished in a conventional manner utilizing the primary impact face 18 of the hammerhead 10.

The above operating procedure may of course be repeated during which time the magnetic flux strength of the magnet insert 42 will naturally deteriorate. When the flux strength of the magnet 42 has deteriorate beyond a minimum value wherein the nail 22 is not maintained within the recess 20 during initial manual swinging of the hammerhead 10, a user need only manually remove the magnetic insert 42 from the cavity 40 and replace the same with an additional substitute magnet insert. As will be recognized, due to the magnet 42 being formed in a conventional design configuration, this replacement can be accomplished rapidly and easily to in effect reujuvenate and, thereby, prolong the useful and effective life of the hammerhead 10.

Figure 3:
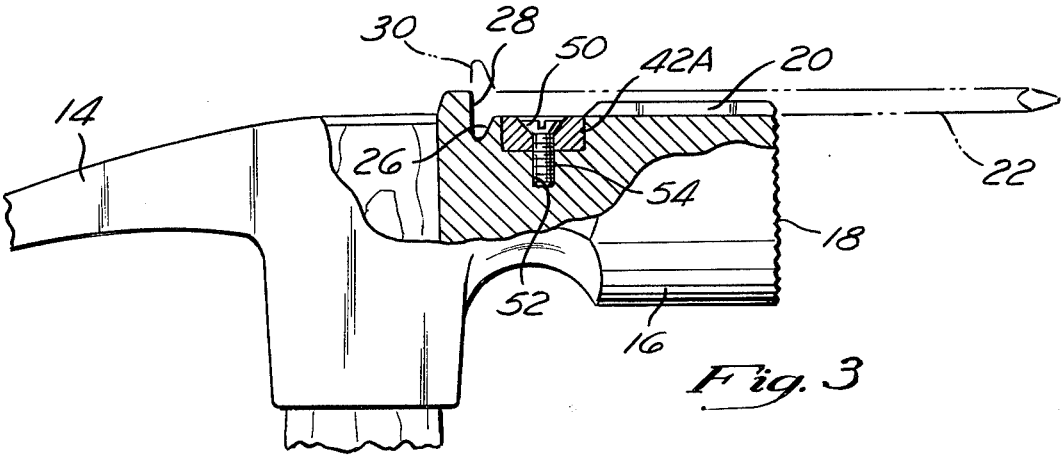
FIG. 3 is a partial cross-sectional view of a second embodiment of the hammerhead of the present invention illustrating its detailed construction.

Referring to FIG. 3, a second embodiment of the improved hammerhead 10 of the present invention is disclosed. In this second embodiment, the structure of the hammerhead 10 is identical to that described in relation to FIGS. 1 and 2 except that the magnet insert 42A is formed to include a counter-sunk aperture 50 extending axially therethrough which is aligned with a threaded aperture 52 formed in the shank portion 16 of the hammerhead. The threaded aperture 52 is sized to receive a conventional flathead machine screw 54 which when inserted through the insert 42A and into the aperture 52, serves to positively secure the insert 54 to the hammerhead 10.

Thus, when it is desired to replace the insert 42A with a new insert 42A, a user need only utilize a screwdriver (not shown) to remove the flathead machine screw 54, remove the spent magnet insert 42A from the pocket 40, re-insert a new magnet insert 42A within the pocket 40, and tighten the machine screw 54 back in place.

Those skilled in the art will recognize that although certain material, sizes, and configurations have been defined in the specifications, various modifications can be made without departing from the spirit of the present invention and such modifications are clearly contemplated herein.

What is claimed is:

1. An improved hammerhead for facilitating initial driving of a nail without holding the nail in the hand of a user comprising:

a head member adapted to be attached to a handle and having a claw portion and shank portion disposed at opposite ends;

a recess formed in the shank portion of said head member extending longitudinally along the length of the shank portion, said recess sized to receive the elongate body of a nail to be driven;

an angular-shaped pocket formed in the shank portion of said head member and aligned with said recess, said pocket sized to receive the head of a nail to be driven;

a cylindrical bore formed in the shank portion of said head member and juxtapositioned said angular shaped pocket;

a magnet insert formed in a complimentary configuration to said bore to be readily manually inserted into said bore and magnetically retain the nail to be driven within said recess and said pocket during swinging of said head member, said magnet insert having a depth equal to or less than the depth of said bore to position one surface of said magnet insert at an elevation below said recess;

an aperture formed axially through said magnet insert;

a threaded aperture formed in said head member and coaxially aligned with said bore; and a fastener sized to be insertable through said aperture and threaded into said threaded aperture to removably retain said magnet insert within said bore.

2. The hammerhead of claim 1 wherein said recess is sized to accommodate the elongate body of differing sized nails to be driven.

3. The hammerhead of claim 2 wherein said angular-shaped pocket is sized to accomodate the head of differing sized nails to be driven.

4. The hammerhead of claim 1 wherein said magnet insert comprises a conventional natural magnet obtainable through building supply retailers.

* * * * *